US011156129B2

(12) United States Patent
Sultana et al.

(10) Patent No.: US 11,156,129 B2
(45) Date of Patent: Oct. 26, 2021

(54) TURBINE ENGINE CASING

(71) Applicant: SAFRAN AIRCRAFT ENGINES, Paris (FR)

(72) Inventors: Patrick Jean Laurent Sultana, Moissy Cramayel (FR); Gaël Frédéric Claude Cyrille Evain, Moissy Cramayel (FR); Olivier Arnaud Fabien Lambert, Moissy Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 4 days.

(21) Appl. No.: 16/799,015

(22) Filed: Feb. 24, 2020

(65) Prior Publication Data

US 2020/0291822 A1 Sep. 17, 2020

(30) Foreign Application Priority Data

Feb. 25, 2019 (FR) ..... 1901889

(51) Int. Cl.
*F01D 25/30* (2006.01)
*F01D 25/26* (2006.01)
*F01D 25/28* (2006.01)

(52) U.S. Cl.
CPC ..... *F01D 25/30* (2013.01); *F01D 25/26* (2013.01); *F01D 25/28* (2013.01); (Continued)

(58) Field of Classification Search
CPC ..... F01D 25/30; F01D 25/305; F01D 25/26; F01D 25/28; F01D 9/065; F05D 2220/323; F05D 2240/14
See application file for complete search history.

(56) References Cited

U.S. PATENT DOCUMENTS 9,644,494 B2 * 5/2017 Hashimoto ..... F01D 25/12
2013/0227930 A1 * 9/2013 Pegan, Jr. ..... F01D 25/162 60/224

FOREIGN PATENT DOCUMENTS

EP 0 342 087 A1 11/1989
EP 2 610 442 A1 7/2013
(Continued)

OTHER PUBLICATIONS

Search Report as issued in French Patent Application No. 1901889, dated Oct. 1, 2019.

*Primary Examiner* — Woody A Lee, Jr.
*Assistant Examiner* — Maxime M Adjagbe
(74) *Attorney, Agent, or Firm* — Pillsbury Winthrop Shaw Pittman LLP

(57) ABSTRACT

A casing of a turbine of a turbine engine includes an internal shroud, an external shroud extending around the internal shroud, and hollow arms connecting the external shroud to the internal shroud and each intended to receive a tubular auxiliary element, each hollow arm defining an inner housing connecting a first passage orifice passing through the internal shroud in the radial direction to a second passage orifice passing through the external shroud in the radial direction, and including an inner wall facing the inner housing. Each arm includes at least one protrusion on the inner wall of the arm protruding from the inner wall towards the inner housing and defining a constriction of the inner housing in a section plane orthogonal to the direction in which the arm extends.

12 Claims, 6 Drawing Sheets

(52) U.S. Cl.
CPC .... *F05D 2220/323* (2013.01); *F05D 2240/14* (2013.01); *F05D 2240/91* (2013.01)

(56) References Cited

FOREIGN PATENT DOCUMENTS

| | | | |
|---|---|---|---|
| EP | 3 483 398 | A1 | 5/2019 |
| FR | 3 050 229 | A1 | 10/2017 |
| FR | 3 061 928 | A1 | 7/2018 |
| FR | 3 064 302 | A1 | 9/2018 |

* cited by examiner

[Fig. 1]
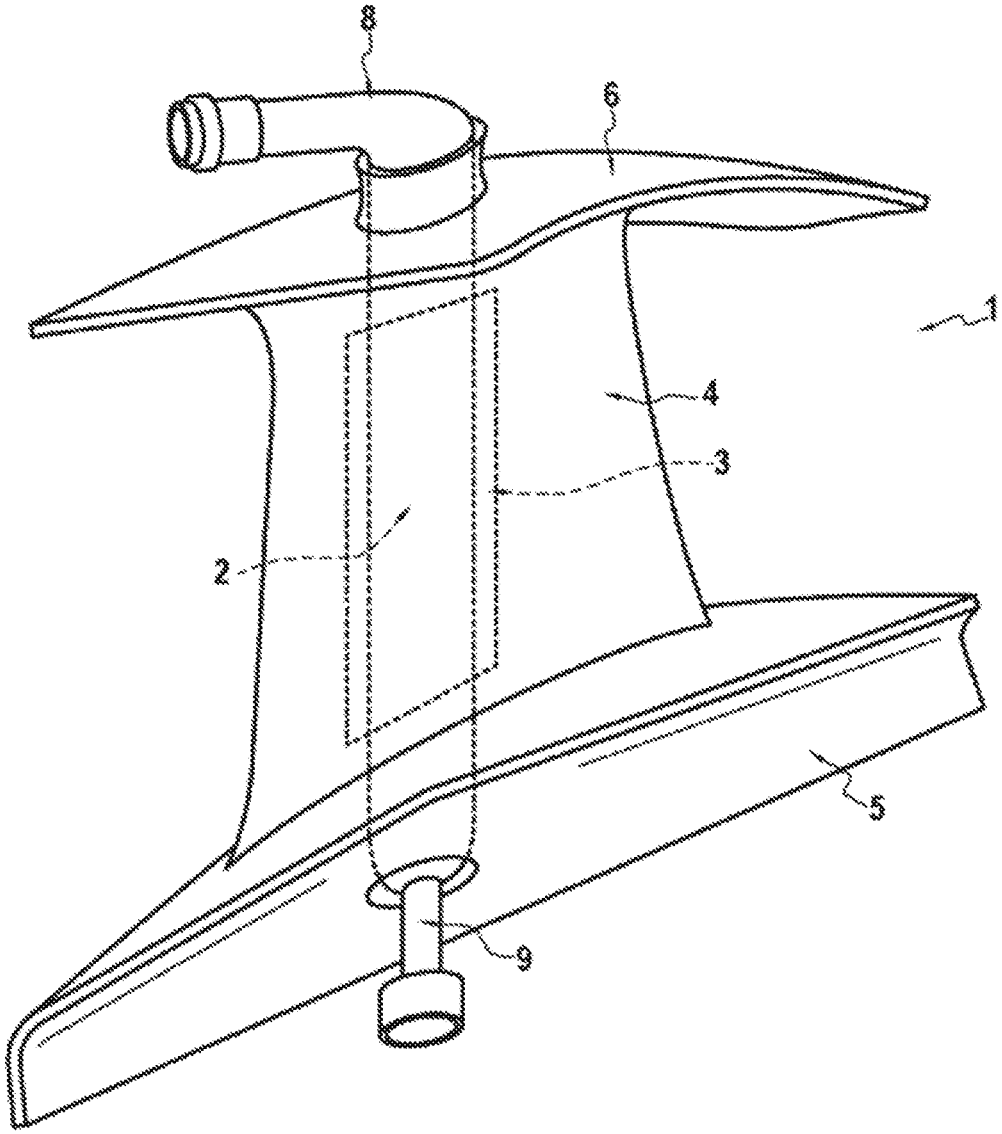

[Fig. 2]
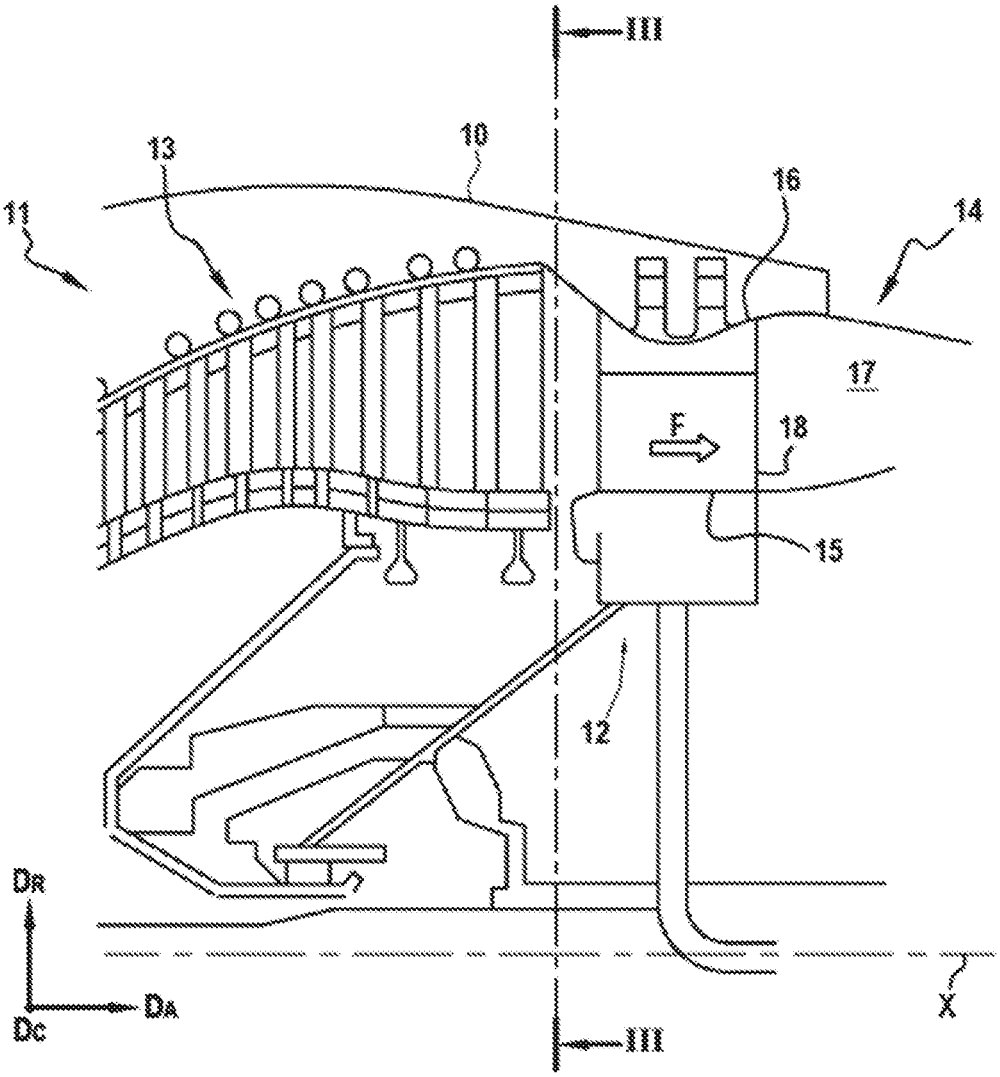

[Fig. 3]
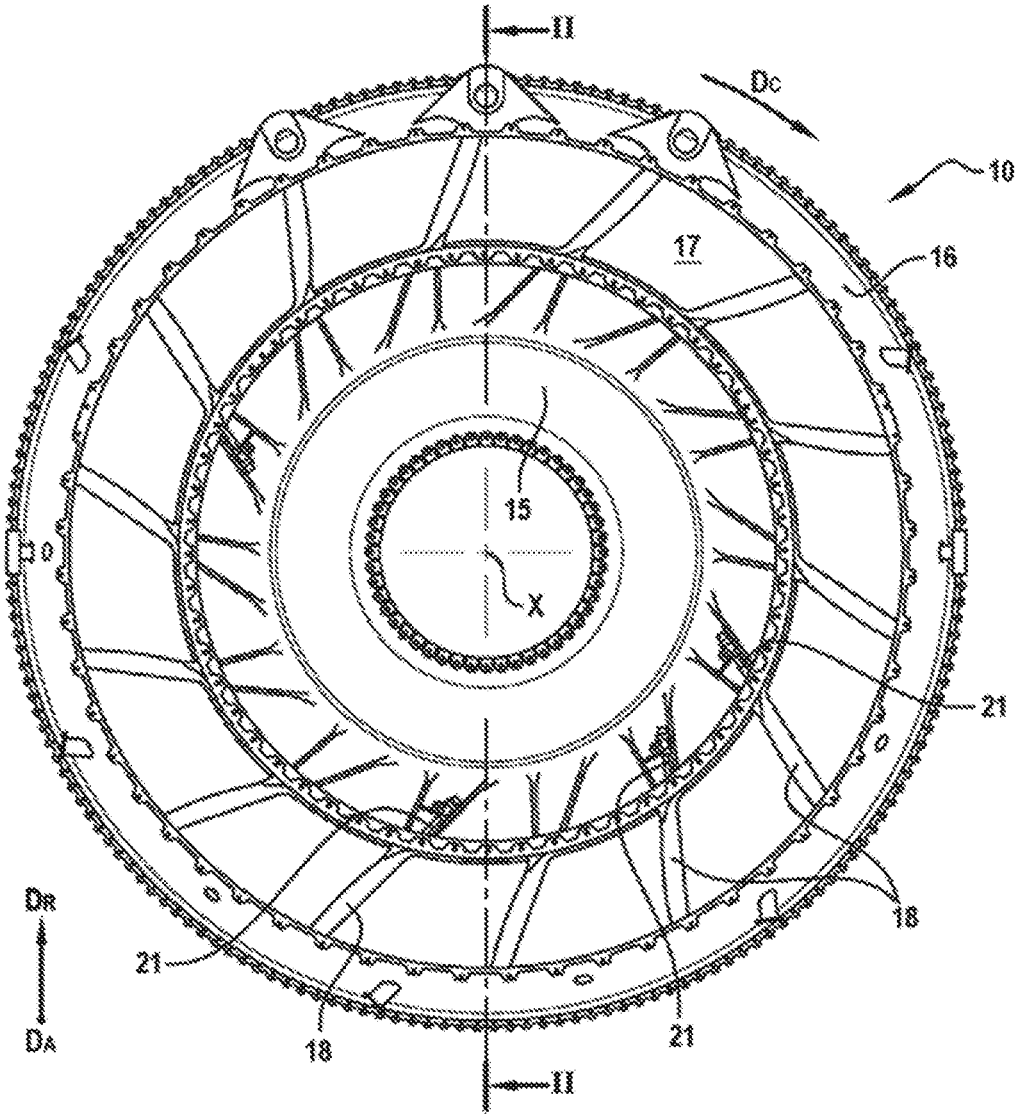

[Fig. 4]
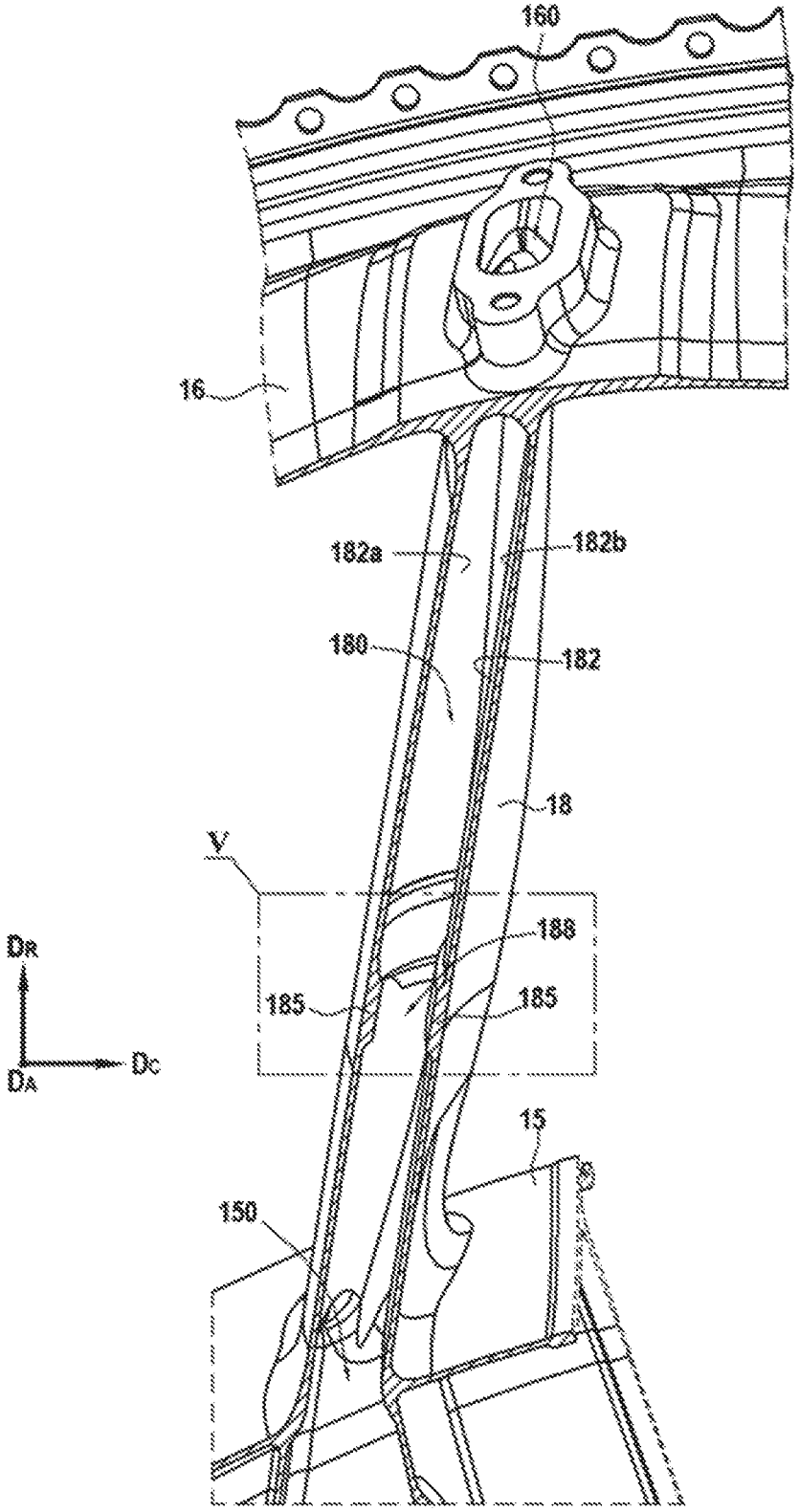

[Fig. 5]
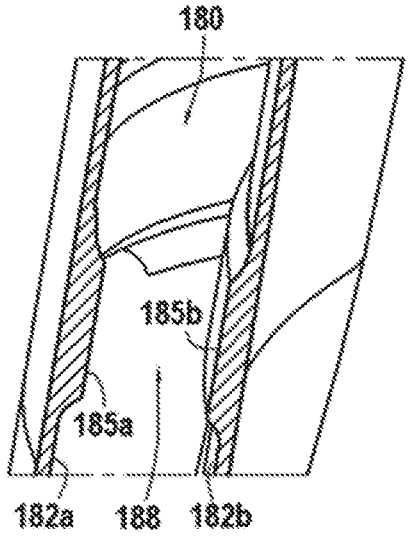
[Fig. 6]
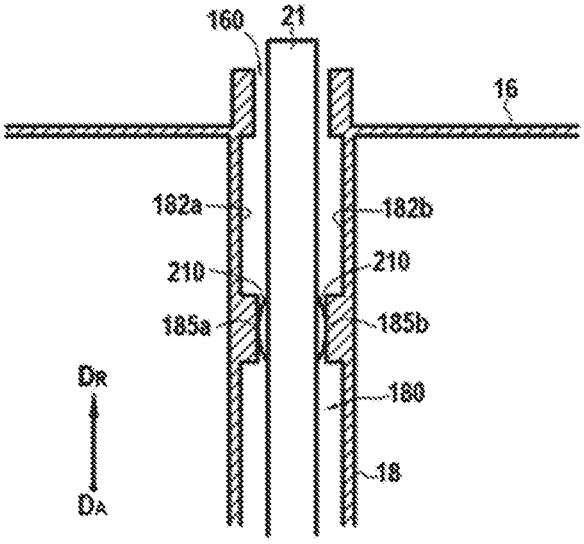

[Fig. 7]
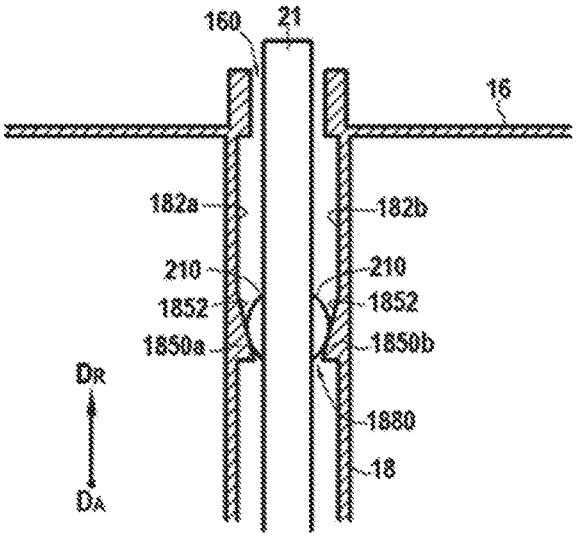

TURBINE ENGINE CASING

CROSS-REFERENCE TO RELATED APPLICATIONS

This application claims priority to French Patent Application No. 1901889, filed Feb. 25, 2019, the entire content of which is incorporated herein by reference in its entirety.

FIELD

The present invention relates to turbine engines, in particular aeronautical turbine engines, and more particularly to an exhaust casing of an aircraft turbine engine.

BACKGROUND

A turbine engine exhaust casing generally comprises an internal hub and an external shroud extending around the hub. The shroud is configured to define with the hub an annular flow path of a gas flow and is rigidly connected to the hub by substantially radial arms relative to a longitudinal axis of the turbine engine. With reference to the flow of gases in the turbine engine, an exhaust casing is mounted downstream of a turbine and the gas flow passing through the exhaust casing is therefore the exhaust gas flow leaving the turbine.

A turbine engine can comprise other similar casings such as an intermediate casing or an inter-turbine casing better known by its designation TVF for "Turbine Vane Frame", or else a TCF designating a "Turbine Center Frame". An intermediate casing is interposed between a low-pressure compressor and a high-pressure compressor of the turbine engine, and is therefore traversed by a gas flow leaving the low-pressure compressor and intended to supply the high-pressure compressor.

The operation of a conventional turbine engine in particular involves the passage of electrical cables and the circulation of various fluids through the turbine engine. For example, these fluids can be air, oil, or oiled air. In order to convey these fluids, it is known to dispose pipes in the structure of the turbine engine. Some of these pipes, called auxiliary tubes, must connect radially outer parts of the turbine engine to radially inner parts, and thus pass through the primary and secondary air flows.

It is known to pass auxiliary elements such as the auxiliary tubes within hollow casing arms such as the hollow arms of an exhaust casing such as a structural exhaust casing such as a TVF, or else a non-structural exhaust casing such as a TRV (downstream turbine rectifier, or "Turbine Rear Vane" according to the generally used terminology), or a TCF (inter-turbine casing, or "Turbine Center Frame" according to the generally used terminology).

The hollow arms of the exhaust casing thus allow the passage of auxiliary elements, such as the auxiliary tubes, without disturbing the flowing of the flow inside the flow path thanks to their inner cavity.

In a general manner, each of the auxiliary elements allows connecting at least one first equipment located radially inside the flow path to at least one second equipment located radially outside the flow path of the casing.

FIG. 1 illustrates an example of a part of an exhaust casing 1 of a turbine engine comprising an auxiliary element in the form of a tube 2 disposed inside a longitudinal cavity 3 provided inside a hollow arm 4 connecting an inner hub 5 to an outer shroud 6 of the exhaust casing 1. The tube 2 is generally introduced into the longitudinal cavity 3 of the hollow arm 4 at the junction between the hollow arm 4 and the outer shroud 6. The tube 2 is then slid inside the cavity 3 until it fully extends therethrough. The tube 2 has two ends 8 and 9 which can be fastened respectively to the inner hub 5 and to the outer shroud 6 in order to secure the tube 2 to the inner hub 5 and to the outer shroud 6. The tube ends 8 and 9 are then assembled to tubes comprised in hydraulic or air circuits disposed in radially outer or inner parts, so as to ensure fluid communication between radially outer parts of the turbine engine and radially inner parts.

As illustrated in FIG. 1, generally, over the majority of the length of the tube 2, the outer surface of the tube is not in contact with the longitudinal cavity wall 3. The tube 2 thus disposed is therefore free to vibrate.

However, the tube 2 has natural vibration frequencies. The tube 2 vibrates most violently when it is excited at these frequencies. This induces rapid fatigue which can go as far as rupture. These frequencies depend on the length of the tube 2, but also on the material which constitutes it, its thickness, or its temperature among others. The longer the tube 2, the lower the smallest natural frequency, and the closer this frequency is to the frequencies of rotation of the low and high pressure bodies of the turbine engine. These vibrations cause robustness and safety problems within the turbine engines. This is particularly true in the case of large motors.

On high power engines, an auxiliary element such as the tube 2 generally includes a longitudinal body defining an elongation axis and at least one wedging damper inside the cavity, this damper allowing in particular to prevent the auxiliary element from entering into resonance, and thus from being degraded, when it is subjected to the different vibrational stresses generated by the turbine engine in operation.

Various dampers exist in the state of the art.

It is known, for example, to use two dampers mounted head to tail each in the form of a curved, flexible blade, and delimited laterally by flanges. Each blade comprises, on the one hand, a portion fastened to the body of the element, and on the other hand, a free portion. Each blade is positioned flat on the auxiliary element, it extends along a transverse axis perpendicular to the elongation axis of the element and is configured to deform in a plane perpendicular to the elongation axis.

The auxiliary element is configured to be mounted in the cavity in a direction substantially parallel to the elongation axis of the element. During mounting thereof, the free portions are constrained so that the latter each exert on a wall delimiting the cavity a return force necessary for the dampers to be able to fully ensure their function.

The mounting/dismounting of the auxiliary element has some difficulties.

Firstly, during the introduction of the auxiliary element into the cavity, the sharp edges present on the flanges of the dampers come into contact with the wall of the cavity and thus oppose its introduction. The operator is then obliged to operate by a back and forth movement and/or to force excessively at the risk of damaging the dampers and/or the wall of the cavity, and to the detriment of productivity. The mounting is all the more critical since the free portions each exert a return force on the wall of the cavity.

Secondly, after the assembly and the difficulties encountered mentioned above, it generally proves to be impossible to dismount the auxiliary element to carry out, for example, a maintenance operation without considerably damaging the dampers and/or the wall of the cavity.

Elastic return stiffeners are known from document FR 3 064 302 and from document FR 3 050 229. They are used so that the natural modes of the auxiliary elements on which they are mounted are not within the operating range of the turbine engine. These stiffeners have similar disadvantages to the dampers, in particular relative to the sensitivity of compression of the stiffeners during the mounting. Indeed, excessive compression of the latter during the mounting can lead to their deterioration and therefore to the absence of contact between the stiffeners and the wall, thus making them ineffective.

A casing arm comprising a passage for an oil tube is also known from document EP 0 342 087, the oil tube comprising a constriction around which a clip is disposed in order to dampen the vibrations occurring on the tube in operation.

It is also known from document FR 3 061 928 a distributor vane comprising a support mast fixed to the casing and held inside the vane by a sleeve to minimize the forces operating on the mast.

SUMMARY

An aspect of the invention aims at overcoming the above disadvantages and at bypassing the difficulties mentioned above by proposing a turbine engine casing allowing to ensure the support of the stiffeners or dampers of the auxiliary elements on the internal wall of its hollow arms with certainty and without sensitivity to the mounting procedure, and more particularly by avoiding any compression of the stiffeners of the auxiliary element during mounting.

An aspect of the invention provides a turbine engine casing, the casing having the shape of a crown defining an axial direction and a radial direction and including an internal shroud, an external shroud extending around and at a distance from the internal shroud, and hollow arms connecting the external shroud to the internal shroud and each intended to receive a tubular auxiliary element, each hollow arm defining an inner housing connecting a first passage orifice passing through the internal shroud in the radial direction to a second passage orifice passing through the external shroud in the radial direction, and including an inner wall delimiting the inner housing.

According to a general characteristic of the invention, each arm comprises at least one protrusion on the inner wall of the arm protruding from the inner wall towards the inner housing and defining a constriction of the inner housing in a section plane orthogonal to the direction in which the arm extends, the at least one protrusion being intended to cooperate with the tubular auxiliary element, the at least one protrusion forming a support for the tubular auxiliary element.

The at least one protrusion even constitutes, in an embodiment, the only support means or system for the tubular auxiliary element located in the housing of the arm radially between the first and the second passage orifice.

In an embodiment, the constriction has in the section plane a passage section smaller than the section of the second passage orifice.

The internal arrangement of the arms with a protrusion allows, firstly, stiffening the holding of the auxiliary element within the arm and thus limiting the risks of resonance.

The internal arrangement of the arms with a protrusion allows, secondly, providing stiffeners on the auxiliary tubes which are shorter and therefore stiffer and thus more effective in their role as dynamic stiffeners than the stiffeners known in the prior art, because the distance between the tube and the arm is locally reduced and the operator does not have to deform the stiffeners himself, the stiffeners deform without assistance during mounting of the tube along its axis.

Finally, the internal arrangement of the arms with a protrusion allows, thirdly, avoiding any plasticization of the stiffeners during their compression upon mounting. Indeed, the operator does not need to compress and plasticize the stiffeners during assembly, their width can easily be dimensioned.

Furthermore, having a section of the inner housing at the protrusion which is smaller than the section of the hollow arm at the orifice through which the auxiliary element is introduced into the arm during its installation allows avoiding any manipulation, such as a compression, of the stiffeners when mounting the auxiliary element in the arm.

According to a first aspect of the casing, the at least one protrusion of each arm can be made of the same material as the arm with which it is associated.

The arm and said at least one protrusion can be made of metal or Inconel 718® for example.

According to a second aspect of the casing, each arm may comprise a protrusion extending over at least half of the perimeter of said inner wall of the inner housing in said section plane orthogonal to the direction in which the arm extends, or at least one pair of protrusions disposed facing one another, to reduce the dimensions of the passage section of the constriction at least in one direction.

According to a third aspect of the casing, the at least one protrusion of each arm can extend, in the direction in which the arm extends between the inner shroud and the outer shroud, over a height comprised between 5 and 10 mm in order to constitute an effective support area for the dampers or the stiffeners of the auxiliary element.

In a fourth aspect of the casing, the at least one protrusion of each arm can extend, in a direction orthogonal to the inner wall of the arm, over a thickness comprised between 1 and 10 mm.

In a fifth aspect of the casing, the at least one protrusion of each arm can be made in one-piece with the arm with which it is associated.

In a sixth aspect of the casing, the at least one protrusion of each arm can form, in a section plane comprising the axial direction and the radial direction, a constriction of the inner housing of an isosceles trapezoidal shape with the largest base disposed between the smallest base and the second passage orifice.

Such a protrusion shape allows an easier compression of the stiffeners or dampers of the auxiliary element when it is fitted into the arm and tightened with screws at the top, for example.

In one variant, the edges between the large base and the small base may be fillets not having a flat surface.

When the at least one protrusion is made in one-piece with the arm, its machining allows compensating for the foundry defects of the arms and the protrusions and thus ensuring the quality of the contact between the stiffeners of the auxiliary element and the arms.

In a seventh aspect of the casing, said casing is an exhaust casing of a turbine of a turbine engine.

An aspect of the invention is also, a turbine comprising a casing as defined above.

Another aspect of the invention is also, a turbine engine comprising a turbine of a turbine engine as defined above.

Another object of the invention is also, an aircraft comprising at least one turbine engine as defined above.

BRIEF DESCRIPTION OF THE DRAWINGS

FIG. 1, already presented, illustrates an example of a part of a turbine engine exhaust casing comprising an auxiliary element.

FIG. 2 is a first sectional view along a first section plane of a turbine engine casing according to an embodiment of the invention.

FIG. 3 shows a second sectional view along a second section plane of the exhaust casing of FIG. 1.

FIG. 4 shows a sectional view of an arm of the exhaust casing according to a first embodiment.

FIG. 5 shows a zoom of FIG. 4 at the protrusion of the arm.

FIG. 6 shows a schematic sectional view of the arm of the exhaust casing of FIG. 4.

FIG. 7 shows a schematic sectional view of the arm of the exhaust casing according to a second embodiment of the invention.

DETAILED DESCRIPTION

FIG. 2 shows a first sectional view along a first section plane II-II of a casing 10 of a double-flow turbine engine 11, the casing 10 comprising an exhaust casing 12 located between a low pressure turbine 13 and a nozzle 14 for ejecting the combustion gases from the turbine 13.

The turbine engine 11 defines an axial direction DA corresponding to the axis of revolution X of the turbine engine 11 and the axis of rotation of the low pressure turbine 13, and a radial direction DR. The first section plane II-II of the turbine engine 11 in FIG. 2 comprises the axial direction DA and the radial direction DR.

Throughout this text, the terms "internal" and "external" or "inner" and "outer" are used with reference to the position or orientation in the radial direction DR relative to the axis of revolution X of the turbine engine 11.

FIG. 3 shows a second sectional view along a second section plane III-III of the turbine engine casing 10 of FIG. 2. The second section plane III-III is orthogonal to the axial direction DA and comprises the radial direction DR. The second section plane is located in the free space between the low pressure turbine 13 and the exhaust casing 12.

As shown in FIGS. 2 and 3, the exhaust casing 12 comprises an internal shroud 15 and an external shroud 16 extending around and at a distance from the internal shroud 15. The external shroud 16 is configured to define with the internal shroud 15 an annular flow path 17 of a combustion gas flow F. The exhaust casing 12 further comprises arms 18 rigidly connecting the external shroud 16 to the internal shroud 15. The arms 18 extend mainly in the radial direction DR relative to the axis of revolution X of the turbine engine 11.

The illustrated embodiment is in no way limiting, the turbine engine 11 may comprise other casings having a similar structure, and thus the exhaust casing 12 could for example be an intermediate casing located between a low-pressure compressor and a high-pressure compressor (not visible in FIG. 2).

In the embodiment illustrated in FIGS. 2 and 3, the exhaust casing 12 comprises a plurality of hollow tubular arms 18 each allowing the passage of one auxiliary element 21.

The passage of the servitude elements 21 into the arms 18 has in particular the benefit of not disturbing the flowing of the gas flow F inside the flow path 17, that is to say of avoiding the pressure drops. An auxiliary element 21 connects at least one first equipment located radially inside the flow path 17 to at least one second equipment located radially outside the flow path 17. Such an element 21 can for example comprise one or more air duct(s) and/or one or more oil duct(s) and/or one or more electric cable(s), etc.

FIG. 4 illustrates a sectional view of an arm 18 of the exhaust casing 12 according to a first embodiment.

The arm 18 has a length in a substantially radial direction DR, a width in the axial direction DA and a thickness in a circumferential direction DC. The length of the arm is greater than the width of the arm which is greater than its thickness. The arm 18 thus has a hollow vane shape, the vane extending mainly in a plane comprising the radial direction DR and the axial direction DA and having a thickness in the circumferential direction DC.

The tubular arm 18 comprises a cavity 180 extending substantially radially between the internal shroud 15 and the external shroud 16. The cavity 180 is delimited by an inner wall 182 of the arm 18. The cavity 180 opens both onto the internal shroud 15 via a first passage orifice 150 and onto the external shroud 16 via a second passage orifice 160. The inner wall 182 comprises two parts 182*a*, 182*b* extending opposite one another.

As illustrated in FIG. 4 as well as in FIG. 5 which is a zoom of a portion of the arm 18 of FIG. 4, each arm 18 comprises two protrusions 185 disposed facing one another and separated by a free space extending in the circumferential direction DC. A first protrusion 185*a* is made on the first part of the inner wall 182*a* while the second protrusion 185*b* is made on the second part of the inner wall 182*b*. The two protrusions 185*a* and 185*b* are made in the middle of the arm 18, namely midway between the internal shroud 15 and the external shroud 16.

FIG. 6 illustrates a schematic sectional view of the arm of the exhaust casing of FIG. 4. As illustrated in FIGS. 4 and 6, in a direction orthogonal to the planes in which extend the two protrusions 185*a* and 185*b*, in other words in a direction orthogonal to two parallel planes which are tangent or coincident with the two wall parts 182*a* and 182*b* of the arm 18, the two protrusions 185*a* and 185*b* define a passage of a dimension smaller than the dimension in the same direction of the passage formed by the second passage orifice 160 of the outer shroud 16.

The two protrusions 185*a* and 185*b* thus form a constriction 188 of the cavity 180 in the middle of the arm 18 which allows ensuring contact between a stiffener 210 of an auxiliary element 21 and the inner wall 182 of the arm 18 at least at a height of the arm 18, that of the protrusions 185*a* and 185*b*. The distance between the auxiliary element 21 and the inner wall 182 being reduced to this height thanks to the protrusions of the stiffeners 210 provided on the auxiliary elements 21 which can be shorter than in the prior art and thus stiffer, which allows improving their efficiency in their role of dynamic stiffener.

In one variant, the two protrusions 185*a* and 185*b* could be formed by a same protrusion made over the entire perimeter of the inner wall 182.

FIG. 7 shows a schematic sectional view of the arm 18 of the exhaust casing 12 according to a second embodiment of the invention.

In the second embodiment illustrated in FIG. 7, the two protrusions 1850*a* and 1850*b* of each arm 18 form, in a section plane comprising the axial direction DA and the radial direction DR, a constriction 1880 of the cavity 180 of an isosceles trapezoidal shape with the largest base disposed between the smallest base and the second passage orifice. In other words, the largest base is disposed radially outside the smallest base to facilitate insertion of the arm from the outside.

As illustrated in FIG. 7, each protrusion 1850*a* and 1850*b* has a generally triangular shape in a section plane orthogonal to the axial direction DA, and more particularly the shape of a right triangle, with one of the sides forming a right angle with the inner wall 182, a first end of its hypotenuse 1852 oriented towards the constriction 1880, that is to say towards the auxiliary element 21, and the second opposite end of the hypotenuse which forms a tip is oriented radially towards the outside of the constriction 1880 and towards the second passage orifice 160 made in the outer shroud 16.

The slope of the triangular shape of the protrusion 1850 allows a compression of the stiffeners 210 of the auxiliary element 21 which is easier when it is fitted into the arm and a compensation for the foundry defects of the arms 18 and of the protrusions 1850*a* and 1850*b* and thus ensuring the quality of the contact between the stiffeners 210 of the auxiliary element 21 and the arm 18.

The invention thus provides a turbine engine casing allowing to ensure the support of the stiffeners or dampers of the auxiliary elements on the inner wall of its hollow arms with certainty while facilitating the mounting, and more particularly avoiding any damage by compression of the stiffeners of the auxiliary element during mounting.

The invention claimed is:

1. A turbine engine casing, the casing having the shape of a crown defining an axial direction and a radial direction and including an internal shroud, an external shroud extending around and at a distance from the internal shroud, and hollow arms connecting the external shroud to the internal shroud and each intended to receive a tubular auxiliary element, each hollow arm defining an inner housing connecting a first passage orifice passing through the internal shroud in the radial direction to a second passage orifice passing through the external shroud in the radial direction, and including an inner wall delimiting the inner housing, wherein each arm comprises at least one protrusion on said inner wall of the arm protruding from the inner wall towards the inner housing and defining a constriction of the inner housing in a section plane orthogonal to the direction in which the arm extends, said at least one protrusion being intended to cooperate with the tubular auxiliary element, said at least one protrusion forming a support for supporting the tubular auxiliary element.

2. The casing according to claim 1, wherein said at least one protrusion of each arm is made of the same material as the arm with which it is associated.

3. The casing according to claim 1, each arm comprising a protrusion extending over at least half of the perimeter of said inner wall of the inner housing in said section plane orthogonal to the direction in which the arm extends, or at least one pair of protrusions disposed facing one another, to reduce the dimensions of a passage section of the constriction in at least one direction.

4. The casing according to claim 1, wherein said at least one protrusion of each arm extends, in the direction in which the arm between the inner shroud and the outer shroud, over a height comprised between 5 and 10 mm.

5. The casing according to claim 1, wherein said at least one protrusion of each arm extends, in a direction orthogonal to the inner wall of the arm, over a thickness comprised between 1 and 10 mm.

6. The casing according to claim 1, wherein said at least one protrusion of each arm is made in one-piece with the arm with which it is associated.

7. The casing according to claim 1, wherein said at least one protrusion of each arm forms, in a section plane comprising the axial direction and the radial direction, the constriction of the inner housing of an isosceles trapezoidal shape with the largest base disposed between the smallest base and the second passage orifice.

8. The casing according to claim 1, wherein said casing is an exhaust casing of a turbine of a turbine engine.

9. A turbine comprising the casing according to claim 1.

10. A turbine engine comprising the turbine according to claim 9.

11. The casing according to claim 1, wherein the at least one protrusion is arranged to provide contact between a portion of the at least one auxiliary element and the inner wall of the hollow arm.

12. The casing according to claim 11, wherein the at least one protrusion is adapted to provide contact between a stiffener of the at least one auxiliary element and the inner wall.

* * * * *